US006176157B1

(12) United States Patent
Ure

(10) Patent No.: US 6,176,157 B1
(45) Date of Patent: Jan. 23, 2001

(54) HYDRO STATIC WRENCH

(76) Inventor: John D. Ure, 208 N. Yale Ave., Arlington Heights, IL (US) 60005

( * ) Notice: Under 35 U.S.C. 154(b), the term of this patent shall be extended for 0 days.

(21) Appl. No.: 09/156,178

(22) Filed: Sep. 17, 1998

(51) Int. Cl.[7] ..... B25B 13/00
(52) U.S. Cl. ..... 81/124.2; 81/176.1
(58) Field of Search ..... 81/124.2, 176.1, 81/176.15, 120, 3.4

(56) References Cited

U.S. PATENT DOCUMENTS

| | | | | |
|---|---|---|---|---|
| 2,522,038 | * | 9/1950 | Houghton | 81/176.15 |
| 3,086,414 | * | 4/1963 | Nardi | 81/176.1 |
| 4,227,266 | | 10/1980 | Russell . | |
| 4,276,163 | | 6/1981 | Gordon . | |
| 4,622,790 | | 11/1986 | Johansson . | |
| 5,036,881 | | 8/1991 | Southmayd . | |
| 5,329,648 | | 7/1994 | Davey . | |
| 5,429,019 | | 7/1995 | Davey . | |
| 5,485,707 | | 1/1996 | Wilkes . | |
| 5,697,268 | * | 12/1997 | Makovsky et al. | 81/176.15 |
| 5,746,416 | * | 5/1998 | Paylor | 251/191 |

FOREIGN PATENT DOCUMENTS

| | | | | |
|---|---|---|---|---|
| 2 193 134 | * | 2/1988 | (GB) | 81/176.1 |

* cited by examiner

*Primary Examiner*—James G. Smith
*Assistant Examiner*—Hadi Shakeri

(74) *Attorney, Agent, or Firm*—Meroni & Meroni; Charles F. Meroni, Jr.

(57) ABSTRACT

This invention concerns a hydro static wrench for removably connecting to a socket wrench for removably engaging and removably installing a hydrostatic relief valve having a cap portion, an axial cap projection, and radial cap extensions. The hydro static wrench comprises a sleeve comprising a body portion, at least one opposing arcuate sidewall, and at least one opposing slotted sidewall. The body portion axially extends along a first axis and has a top planar portion and a bottom planar portion located opposite and parallel the top planar portion. The top planar portion has a projected polygonal aperture for removably engaging the socket wrench and the bottom planar portion has a polygonal aperture for removably engaging the axial cap projection. The at least one opposing arcuate sidewall axially extends along the first axis from the top planar portion to below the bottom planar portion and radially extends along a second axis perpendicular to the first axis for creating a lip structure capable of concentrically enclosing and removably engaging the cap portion. The at least one opposing slotted sidewall axially extends along the first axis from the top planar portion to below the bottom planar portion and is slotted radially along a third axis perpendicular to the first axis and the second axis for creating a passageway capable of receiving the radial cap extensions. The sleeve has sufficient strength for axially revolving about the first axis and for removably installing the hydrostatic relief valve along the first axis.

14 Claims, 4 Drawing Sheets

HYDRO STATIC WRENCH

BACKGROUND OF THE INVENTION

1. Field of the Invention

The present invention relates to devices for relieving hydrostatic pressure. More specifically, my invention is primarily intended for use in removably installing hydrostatic pressure relief valves in drain systems.

2. Description of the Related Art

In the art of hydrostatic pressure relief systems it is known that hydrostatic pressure caused by sources, such as ground water, can damage or disrupt in-ground or underground structures, such as swimming pools and the like. This hydrostatic pressure is the result of the difference in head of the water level external to the structure and the water level internal to the structure.

Various devices or systems have been created in an attempt to solve these problems or at least provide a means for meaningful remediation. For example, the system of U.S. Pat. No. 4,227,266 utilizes a pumping system activated by a float-control system while the device of U.S. Pat. No. 4,622,790 utilizes a sealing layer 7, a relieving layer 8, and a draining pipe system 9. Furthermore, U.S. Pat. No. 5,036,881 utilizes a system relying upon a one-way flow valve comprising a plunger and compatible conical surface while U.S. Pat. No. 5,485,707 uses a sleeve and associated removable plug which is inserted by use of a tool 70 having a cylindrical knurled handle 72 and a narrower coaxial cylindrical shaft 74.

What is not taught in the art, as far as I have seen, is a tool for removably installing a hydrostatic pressure relief valve. In specific, a tool that would fit right on top of the valve and would easily remove or install the valve regardless of the tightness of the fitting and while the valve is removably placed in a drain system, such as that on a swimming pool.

Accordingly, it is a principal object of my invention to provide a hydro static wrench and assembly for removably installing a hydrostatic pressure relief valve.

It is a further object of my invention to provide the means for a quick, easy removable installation of the valve.

It is a still further object of my invention to provide a means for utilizing a socket-type wrench to apply the necessary torque for such removable installation.

It is a further object of my invention to provide a valve which is removably installed and which is capable of releasing pressure from sources, such as ground water, on its own.

It is a still further object of my invention to provide a means for the ease of removable installation of the valve while in a drain system, such as those found in swimming pools.

Other objects of my invention, as well as particular features, elements, and advantages thereof will be elucidated in, or apparent from, the following description and the accompanying drawing figures.

SUMMARY OF THE INVENTION

According to my present invention I have provided a hydro static wrench for removably connecting to a socket wrench for removably engaging and removably install a hydrostatic relief valve having a cap portion, an axial cap projection, and radial cap extensions, the hydro static wrench comprising: a sleeve comprising a body portion, at least one opposing arcuate sidewall, and at least one opposing slotted sidewall, the body portion axially extending along a first axis and having a top planar portion and a bottom planar portion located opposite and parallel the top planar portion, the top planar portion having a projected polygonal aperture for removably engaging the socket wrench, the bottom planar portion having a polygonal aperture for removably engaging the axial cap projection, the at least one opposing arcuate sidewall axially extending along the first axis from the top planar portion to below the bottom planar portion and radially extending along a second axis perpendicular to the first axis for creating a lip structure for concentrically enclosing and removably engaging the cap portion, the at least one opposing slotted sidewall axially extending along the first axis from the top planar portion to below the bottom planar portion and being slotted radially along a third axis perpendicular to the first axis and the second axis for creating a passageway for receiving the radial cap extensions, the sleeve having sufficient strength for axially revolving about the first axis and for removably install the hydrostatic relief valve along the first axis.

In another embodiment, I have provided a first wrench assembly for removably installing a hydrostatic pressure relief valve having a cap portion and at least one radial cap extension laterally extending from the cap portion, the wrench assembly comprising: a socket-style wrench and a hydro static wrench. The hydro static wrench comprising a body portion having a top planar surface and a bottom planar surface being located parallel and opposite the top planar surface, the top planar surface for detachably engaging the socket-style wrench and the bottom planar surface for removably connecting the hydro static wrench to the cap portion, the body portion further comprising a plurality of opposing arcuate-shaped surfaces laterally extending in a first direction perpendicular to an axial axis and axially extending a length measured from the top planar surface to below the bottom planar surface for creating a lip structure for concentrically enclosing and grasping the cap portion when the hydro static wrench is removably placed upon the hydrostatic pressure relief valve along the axial axis, the plurality of opposing arcuate-shaped surfaces being transversely slotted along the length in a second direction perpendicular to the first direction and the axial axis for allowing sufficient passageway for the at least one radial cap extension during removable placement of the hydro static wrench upon the hydrostatic pressure relief valve.

In a further embodiment, I have provided a second wrench assembly comprising: a socket-style wrench, a hydrostatic pressure relief valve comprising a cap portion and at least one radial cap extension laterally extending from the cap portion, and a hydro static wrench. The hydro static wrench comprising a body portion having a top planar surface and a bottom planar surface being located parallel and opposite the top planar surface, the top planar surface for detachably engaging the socket-style wrench and the bottom planar surface for removably connected to the cap portion, the body portion further comprising a plurality of opposing arcuate-shaped surfaces laterally extending in a first direction perpendicular to an axial axis and axially extending a length measured from the top planar surface to below the bottom planar surface for creating a lip structure for concentrically enclosing and grasping the cap portion when the hydro static wrench is removably placed upon the hydrostatic pressure relief valve, the plurality of opposing arcuate-shaped surfaces being transversely slotted along the length in a second direction perpendicular to the first direction and to the axial axis for allowing sufficient passageway for the at least one radial cap extension during removable placement of the hydro static wrench upon the hydrostatic pressure relief valve.

DESCRIPTION OF THE DRAWINGS

Other features of my invention will become more evident from a consideration of the following detailed description of my patent drawings, as follows.

DETAILED DESCRIPTION OF THE PREFERRED EMBODIMENT

Figure 1:
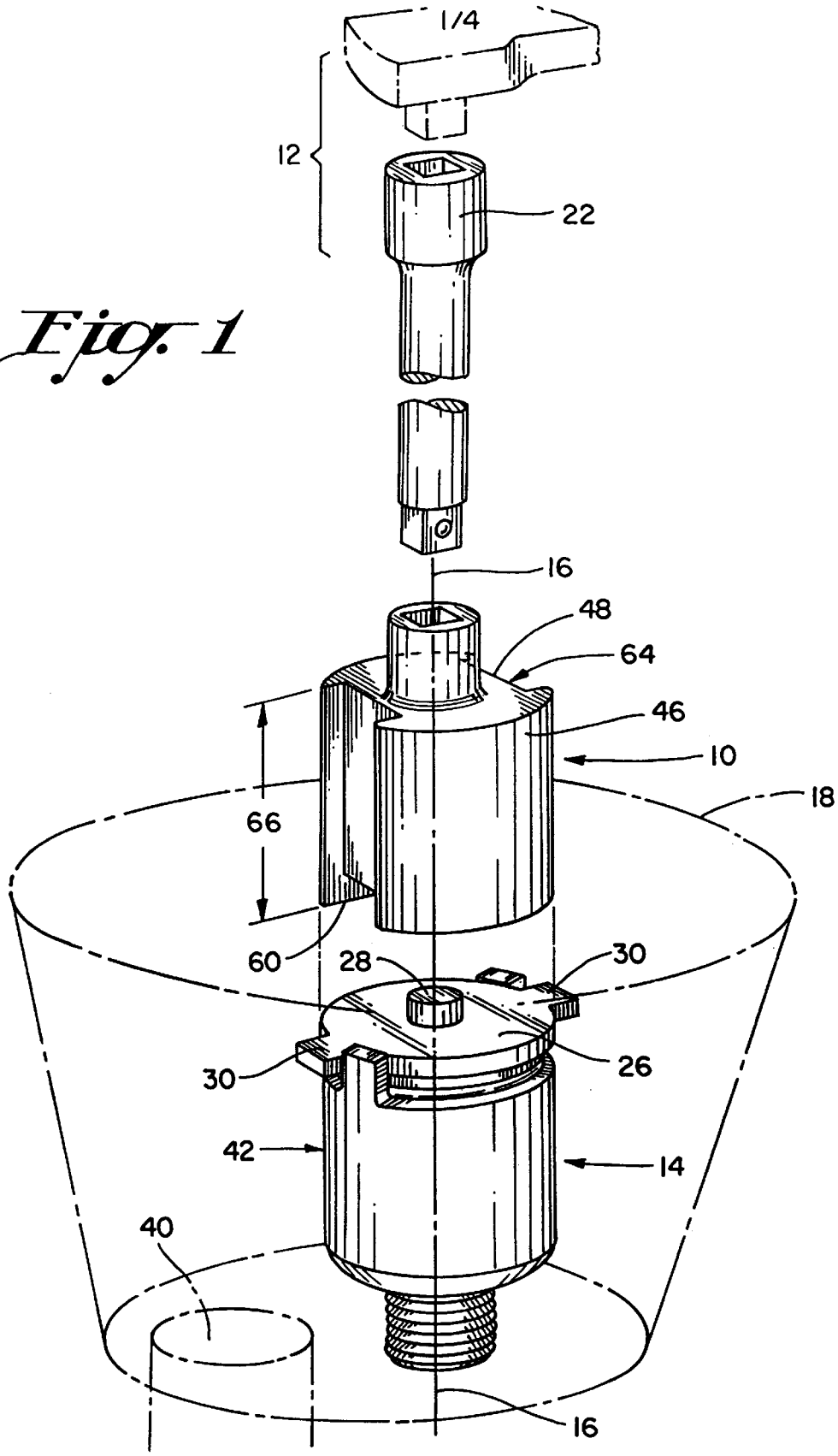
FIG. 1 is a perspective exploded view of an embodiment of my invention, the hydro static wrench showing its removable engagement to a socket wrench and to a hydrostatic relief valve in a drain system.
Figure 2:
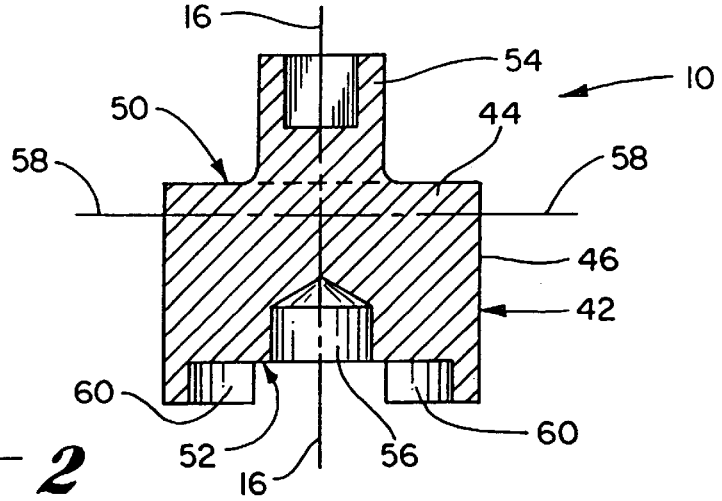
FIG. 2 is a sectional view of the embodiment of FIG. 1 showing a projected polygonal aperture for removable engagement to the socket wrench and a polygonal aperture for removable engagement to an axial cap projection of the hydrostatic relief valve.

Referring now to the drawings, my invention concerns a hydro static wrench and various wrench assemblies comprising the hydro static wrench for the removable installation of a hydrostatic relief valve, or hydrostatic pressure relief valve as it is known in the art. FIGS. 1–5 show my invention, the hydro static wrench 10. FIGS. 1 and 5 illustrate the various wrench assemblies that can include the hydro static wrench of the present invention.

Figure 5:
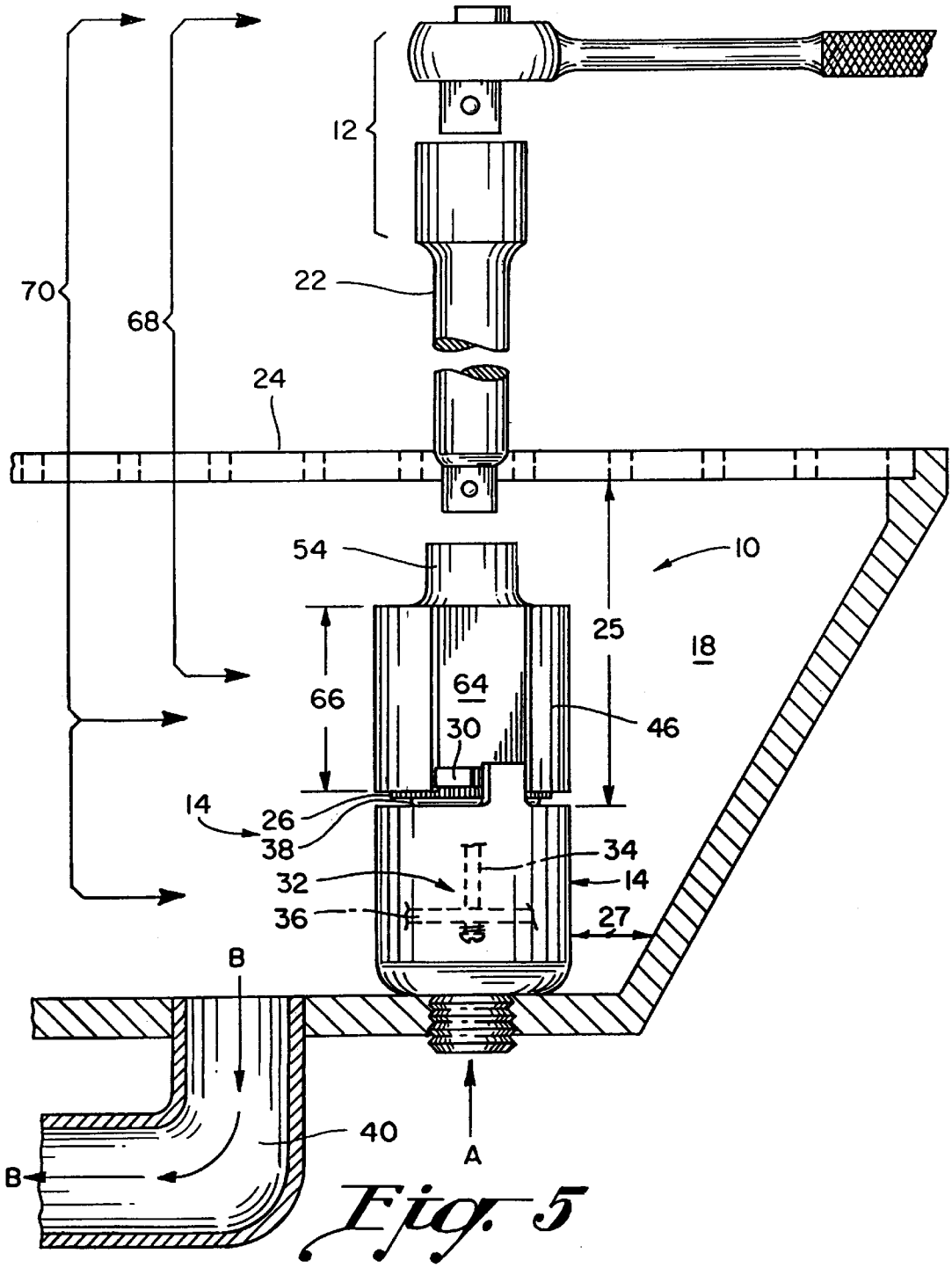
FIG. 5 is a side view of the embodiment of FIG. 1, showing the hydro static wrench, its removable engagement to a socket wrench and to a hydrostatic relief valve in a drain system, and the direction of water flow in the drain system.
Figure 6:
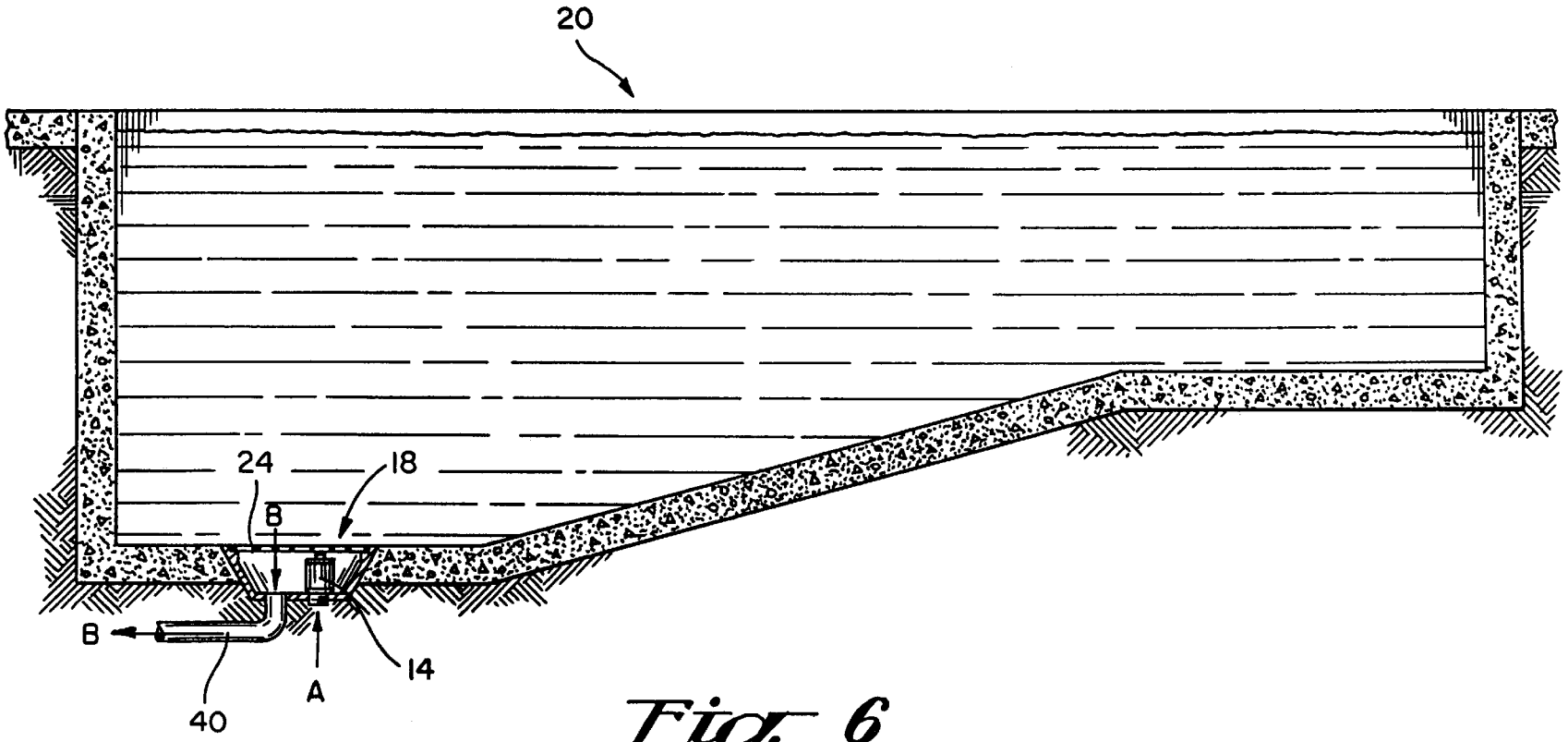
FIG. 6 is a side view showing the placement of the hydrostatic relief valve in the drain system of a swimming pool wherein my invention has particular use.

FIGS. 1 and 5 show the hydro static wrench 10 and its removable connection to a socket wrench 12 to removably engage and removably install the hydrostatic relief valve 14 as directed along an axial axis 16, or first axis as it is known in other embodiments. Also shown in FIGS. 1 and 5 is the removable installation of the hydrostatic relief valve in a drain system 18, such as that found in a swimming pool 20 or similar structure, as shown in FIG. 6. It is not intended that my invention be limited to use in a swimming pool, but that my invention be used in any drain system wherein the hydrostatic relief valve and any like valves are used.

In addition, the socket wrench 12, or socket-style wrench as it is known in the art is preferably a ratchet-type wrench, as shown in FIGS. 1 and 5. Furthermore, it is preferred that the socket-style wrench have socket extension capability 22 and be able to detachably engage the hydro static wrench 10 along the axial axis 16 to assist the removable installation of the hydrostatic pressure relief valve 14. This type of wrench is particularly useful in applying the necessary torque needed to removably install the valve in tight places, such as in the drain system 18 shown in FIGS. 1, 5, and 6. In fact, when the valve is placed below a grate 24 by a distance 25 of 1.5 to 2 inches and is placed at a second distance 27 of 0.5 inches from a wall of the drain system, it is imperative that the socket wrench have the extension capabilities in order to maneuver and use the hydro static wrench. In addition, the radial shape of the hydro static wrench is important for such maneuvering and will be described below. A socket fitting of 0.5 inch is preferred for the wrench connections and the socket-style wrench and the hydro static wrench are each intended to be sufficiently sized to remove the hydrostatic pressure relief valve.

Another critical aspect taken into account in the design and functioning of my invention is that the hydrostatic relief valve 14, as shown in FIGS. 1 and 5, has a cap portion 26, an axial cap projection 28, and radial cap extensions 30. In other embodiments, the cap portion is a cap structure and the radial cap extension is at least one radial cap extension laterally extending from the cap portion or is two radial cap extensions or is cap extensions. In addition, the valve can be constructed of brass.

The hydrostatic pressure relief valve 14 also has a 1, 1.5, or 2 inch threaded size, as shown in FIGS. 1 and 5 and has an adjustable and sealable pressure relief means 32 as shown in FIG. 5. The adjustable and sealable pressure relief means is a spring-loaded threaded bolt 34 removably attached to the cap portion 26 to thereby apply adjustable tension to the cap portion and to allow for water pressure relief and be mountably attached to a stationary bracket 36. This pressure relief valve can act independently of any other valve and on its own. The cap portion in turn, is sealed by means of a rubber gasket 38.

This adjustable, sealable pressure relief system thereby allows water, such as ground water, to move in the direction of arrow A, as shown in FIGS. 5 and 6, and to push up against the cap portion 26 thereby releasing the hydrostatic pressure in the ground or surrounding area. This water can then join any water draining into the drain system 18 and drain away or be suctioned away, arrow B, from the structure 20 through a pipe 40 and exit the system to a filter (not shown). Typically, the drain system is placed in the deep end of the pool 20 or structure. In addition, the hydrostatic pressure relief valve 14 threads clockwise into the drain system.

The hydro static wrench 10 is shown in FIGS. 1–5 and comprises a sleeve 42 in an embodiment and in other embodiments can be analogized to the sleeve, by virtue of its axial placement upon the hydrostatic relief valve, and is thereby described as a body portion 44. The sleeve comprises the body portion 44, at least one opposing arcuate sidewall 46, and at least one opposing slotted sidewall 48. The body portion axially extends along the first axis 16 and has a top planar portion 50 and a bottom planar portion 52 located opposite and parallel the top planar portion. The top planar portion has a projected polygonal aperture 54 centrally attached for removably engaging or removably connecting the hydro static wrench 10 to the socket wrench 12 along the axial axis 16. The bottom planar portion has a polygonal aperture 56 for removably engaging or removably connecting the hydro static wrench 10 to the axial cap projection 28 of the hydrostatic pressure relief valve 14 which extends along the axial axis and the bottom planar portion for removable connection to the cap portion 26.

In other embodiments, the top planar portion is a top planar surface while the bottom planar portion is a bottom planar surface.

As a critical feature and as shown in FIGS. 2–5, the at least one opposing arcuate sidewall 46 axially extends along the first axis 16 from the top planar portion 50 to below the bottom planar portion 52 and radially extends along a second axis 58, also known as a first direction, perpendicular to the first axis 16 to thereby create a lip structure 60 capable of concentrically enclosing and removably engaging the cap portion 26. In addition, the at least one opposing slotted sidewall 48 axially extends along the first axis from the top planar portion 50 to below the bottom planar portion 52 and is slotted radially along a third axis 62, also known as a second direction, perpendicular to the first axis and the second axis to thereby create a passageway 64 capable of receiving the radial cap extensions 30.

Figure 3:
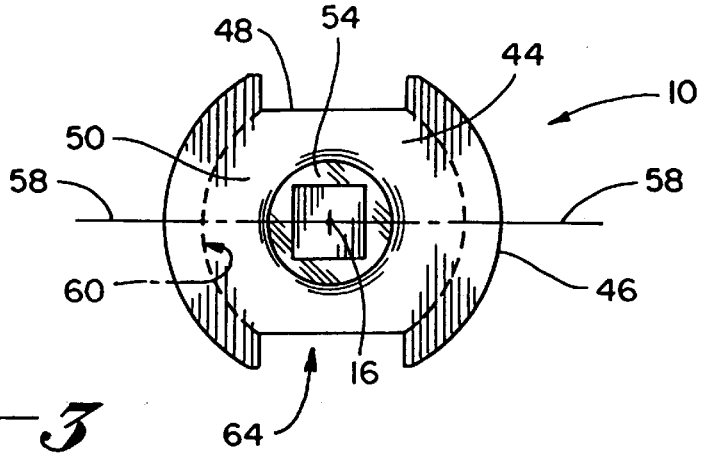
FIG. 3 is a top view of the embodiment of FIG. 2 showing the projected polygonal aperture, the top planar portion, the at least one opposing arcuate sidewall, and the at least one opposing slotted sidewall.
Figure 4:
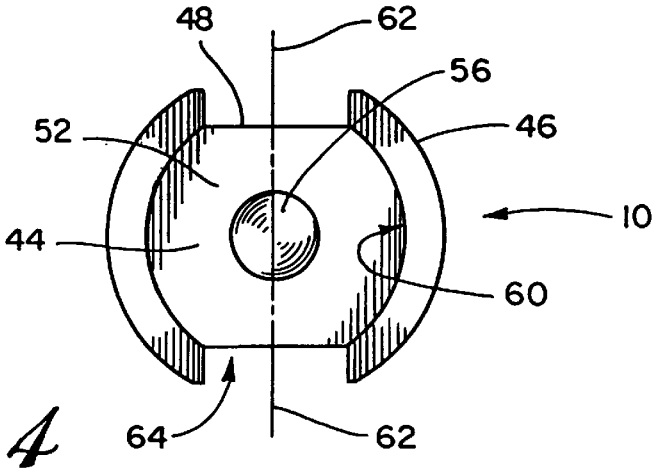
FIG. 4 is a bottom view of the embodiment of FIG. 2 showing the polygonal aperture, the bottom planar portion, the at least one opposing arcuate sidewall, and the at least one opposing slotted sidewall.

In other embodiments, the at least one opposing arcuate sidewall 46 is two opposing arcuate sidewalls, or two surfaces, that are spaced 180 degrees apart, as shown in FIGS. 1, 3, and 4. In addition, the at least one opposing slotted sidewall 48 is two opposing slotted sidewalls spaced 180 degrees apart from each other or is transversely slotted along two surfaces spaced 180 degrees apart from each other and extends a length 66. The passageway 64 then extends along the first axis 16 from the top planar portion 50 to below the bottom planar portion 52 and the sleeve 42 can substantially enclose the cap portion 26 when directed along the first axis, as shown in FIGS. 1 and 5.

Accordingly, the sleeve 42 has sufficient strength to axially revolve about the first axis 16 and to removably install the hydrostatic relief valve 14 along the first axis and therefore is intended to be constructed of such materials as are commonly used in the art. The hydro static wrench 10 is also intended to be sized to fit the 1, 1.5, and 2 inch sizes of the hydrostatic relief valve. In like manner, in other embodiments, the body portion 44 is a solid body portion extending along the first axis so as to provide the necessary strength for torquing action.

In another embodiment, the at least one opposing arcuate sidewall 46 is a plurality of opposing arcuate-shaped surfaces that laterally extend in the first direction 58 perpendicular to the axial axis 16 and axially extend the length 66 measured from the top planar surface 50 to below the bottom planar surface 52 for creating the lip structure 60 capable of concentrically enclosing and grasping the cap structure 26, or substantially enclosing it, when the hydro static wrench 10 is removably placed upon the hydrostatic pressure relief valve 14 along the axial axis 16. The plurality of opposing arcuate-shaped surfaces are transversely slotted along the length in the second direction 62 perpendicular to the first direction and the axial axis for allowing sufficient passageway for the cap extensions 30 during removable placement of the hydro static wrench upon the hydrostatic pressure relief valve 14.

In further embodiments of my invention I provide a first wrench assembly 68 comprising the socket-style wrench 12 and the hydro static wrench 10 detachably engaging the socket-style wrench as described above. I also provide a second wrench assembly 70 comprising the socket-style wrench, the hydrostatic pressure relief valve 14, and the hydro static wrench 10 as described above.

In construction and in use the overall objects of my invention are therefore met as the hydro static wrench 10 or the combination of the socket-style wrench 12 and the hydro static wrench detachably engage each other and are usable, capable, and instrumental in removably installing the hydrostatic relief valve 14 in a swimming pool drain system 18, or like drain system. The opposing arcuate sidewalls 46 or the plurality of opposing arcuate-shaped surfaces are also shaped so as to removably install the hydrostatic relief valve in the swimming pool drain system, or like drain system, in a direction along the first axis 16 or axial axis without interfering with the drain system and with relative ease of operation and removable installation.

As various possible embodiments may be made in the above invention for use for different purposes and as various changes might be made in the embodiments and methods above set forth, it is understood that all of the above matters here set forth or shown in the accompanying drawings are to be interpreted as illustrative and not in a limiting sense.

I claim:

1. A hydro static wrench for removably connecting to a socket wrench for removably engaging and removably installing a hydrostatic relief valve having a cap portion, an axial cap projection, and radial cap extensions, the hydro static wrench comprising:

a sleeve comprising a body portion, at least one opposing arcuate sidewall, and at least one opposing slotted sidewall, the body portion axially extending along a first axis and having a top planar portion and a bottom planar portion located opposite and parallel the top planar portion, the top planar portion having a projected polygonal aperture for removably engaging the socket wrench, the bottom planar portion having a polygonal aperture for removably engaging the axial cap projection, the at least one opposing arcuate sidewall axially extending along the first axis from the top planar portion to below the bottom planar portion and radially extending along a second axis perpendicular to the first axis for creating a lip structure for concentrically enclosing and removably engaging the cap portion, the at least one opposing slotted sidewall axially extending along the first axis from the top planar portion to below the bottom planar portion and being slotted radially along a third axis perpendicular to the first axis and the second axis for creating a passageway for receiving the radial cap extensions, the sleeve having sufficient strength for axially revolving about the first axis and for removably installing the hydrostatic relief valve along the first axis.

2. The hydro static wrench of claim 1, wherein the body portion is a solid body portion extending along the first axis, the at least one opposing arcuate sidewall is two opposing arcuate sidewalls spaced 180 degrees apart, the at least one opposing slotted sidewall is two opposing slotted sidewalls spaced 180 degrees apart and the passageway extends along the first axis from the top planar portion to below the bottom planar portion, the sleeve for substantially enclosing the cap portion when directed along the first axis.

3. The hydro static wrench of claim 2, wherein the socket wrench is a ratchet-type wrench, the hydro static wrench is usable for removably installing the hydrostatic relief valve in a swimming pool drain system, and the opposing arcuate sidewalls are shaped for removably installing the hydrostatic relief valve in the swimming pool drain system along the first axis.

4. The hydro static wrench of claim 3, wherein the hydro static wrench is sized for removing the hydrostatic relief valve having a 1, 1.5, or 2 inch threaded size.

5. A hydro static wrench for removably connecting a socket-style wrench and removably installing of a hydrostatic pressure relief valve having a cap structure and cap extensions, the hydro static wrench comprising:

a solid body portion having a top planar surface and a bottom planar surface being located parallel and opposite the top planar surface, the top planar surface being removably connected to the socket-style wrench and the bottom planar surface being removably connected to the hydrostatic pressure relief valve, the solid body portion further comprising a plurality of opposing arcuate-shaped surfaces laterally extending in a first direction perpendicular to an axial axis and axially extending a length measured from the top planar surface to below the bottom planar surface for creating a lip structure capable of concentrically enclosing and grasping the cap structure when the hydro static wrench is removably placed upon the hydrostatic pressure relief valve along the axial axis, the plurality of opposing arcuate-shaped surfaces being transversely slotted along the length in a second direction perpendicular to the first direction and the axial axis for allowing sufficient passageway for the cap extensions during removable placement of the hydro static wrench upon the hydrostatic pressure relief valve.

6. The hydro static wrench of claim 5, wherein the plurality of opposing arcuate-shaped surfaces are two surfaces spaced 180 degrees apart and the plurality of opposing arcuate-shaped surfaces are transversely slotted along two surfaces spaced 180 degrees apart from each other and extending the length, the plurality of opposing arcuate-shaped surfaces for substantially enclosing the cap structure when directed along the axial axis while allowing sufficient passageway for the cap extensions.

7. The hydro static wrench of claim 5, wherein the socket-style wrench is a ratchet-type wrench, the hydro static wrench for removably installing the hydrostatic pressure relief valve in a swimming pool drain system, and the plurality of opposing arcuate-shaped surfaces are shaped for removably installing the hydrostatic pressure relief valve in the swimming pool drain system along the axial axis.

8. The hydro static wrench of claim 5, wherein the hydro static wrench is sufficiently sized for removing the hydrostatic pressure relief valve having a 1, 1.5, or 2 inch threaded size.

9. The hydro static wrench of claim 5, the cap structure further comprising an axial cap projection, the top planar surface further comprising a projected polygonal aperture centrally attached for removably engaging the socket-style wrench along the axial axis, the bottom planar surface having a polygonal aperture for removably engaging the axial cap projection.

10. A first wrench assembly for removably installing a hydrostatic pressure relief valve having a cap portion and at least one radial cap extension laterally extending from the cap portion, first the wrench assembly comprising:

a socket-style wrench; and a hydro static wrench comprising a body portion having a top planar surface and a bottom planar surface being located parallel and opposite the top planar surface, the top planar surface for detachably engaging the socket-style wrench and the bottom planar surface for removably connecting the hydro static wrench to the cap portion, the body portion further comprising a plurality of opposing arcuate-shaped surfaces laterally extending in a first direction perpendicular to an axial axis and axially extending a length measured from the top planar surface to below the bottom planar surface for creating a lip structure for concentrically enclosing and grasping the cap portion when the hydro static wrench is removably placed upon the hydrostatic pressure relief valve along the axial axis, the plurality of opposing arcuate-shaped surfaces being transversely slotted along the length in a second direction perpendicular to the first direction and the axial axis for allowing sufficient passageway for the at least one radial cap extension during removable placement of the hydro static wrench upon the hydrostatic pressure relief valve.

11. The first wrench assembly of claim 10, the cap portion further comprising an axial cap projection extending along the axial axis, the top planar surface further comprising a projected polygonal aperture centrally attached for removably engaging the socket-style wrench along the axial axis, the bottom planar surface having a polygonal aperture for removably engaging the axial cap projection, and the socket-style wrench being a ratchet-type wrench having socket extension capability and detachably engaging the hydro static wrench along the axial axis for assisting the removable installation of the hydrostatic pressure relief valve.

12. The first wrench assembly of claim 11, wherein the body portion is a solid body portion extending along the axial axis, for removably installing the hydrostatic pressure relief valve in a swimming pool drain system, and the plurality of opposing arcuate-shaped surfaces being shaped for removably installing the hydrostatic pressure relief valve in the swimming pool drain system in a direction along the axial axis.

13. The first wrench assembly of claim 11, wherein the plurality of opposing arcuate-shaped surfaces are two surfaces spaced 180 degrees apart and the plurality of opposing arcuate-shaped surfaces are transversely slotted along two surfaces spaced 180 degrees apart from each other and extending the length, the plurality of opposing arcuate-shaped surfaces for substantially enclosing the cap structure when directed along the axial axis while allowing sufficient passageway for the at least one radial cap extension.

14. The first wrench assembly of claim 13, wherein the hydro static wrench is sized to remove the hydrostatic pressure relief valve having a 1, 1.5, or 2 inch threaded size, and the at least one radial cap extension is two radial cap extensions.

* * * * *